US006283468B1

(12) United States Patent
Sugiura

(10) Patent No.: US 6,283,468 B1
(45) Date of Patent: Sep. 4, 2001

(54) SHEET FEEDING DEVICE

(75) Inventor: Toshio Sugiura, Anjyou (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 09/370,983

(22) Filed: Aug. 10, 1999

(30) Foreign Application Priority Data

| | | |
|---|---|---|
| Aug. 11, 1998 | (JP) | 10-227040 |
| Aug. 11, 1998 | (JP) | 10-227054 |
| Aug. 3, 1999 | (JP) | 11-220505 |
| Aug. 3, 1999 | (JP) | 11-220506 |

(51) Int. Cl.[7] ..... B65H 3/06; B65H 3/52; B65H 1/08

(52) U.S. Cl. ..... 271/119; 271/121; 271/127

(58) Field of Search ..... 271/119, 120, 271/127, 160, 121, 122, 124, 126; 399/393; 400/629

(56) References Cited

U.S. PATENT DOCUMENTS

| | | | | |
|---|---|---|---|---|
| 4,815,724 | * | 3/1989 | Sumida et al. | 271/121 |
| 5,253,854 | * | 10/1993 | Tanoue et al. | 271/10 X |
| 5,316,285 | | 5/1994 | Olson et al. . | |
| 5,386,983 | * | 2/1995 | Ando | 271/118 X |
| 5,725,208 | * | 3/1998 | Miyauchi | 271/10.09 X |
| 6,135,444 | * | 10/2000 | Padget | 271/121 |

FOREIGN PATENT DOCUMENTS

| | | |
|---|---|---|
| 61-38146 | 2/1986 | (JP) . |
| 2-66533 U | 5/1990 | (JP) . |
| 3-56736 U | 5/1991 | (JP) . |
| 3-152037 | 6/1991 | (JP) . |
| 5-147831 | 6/1993 | (JP) . |
| 6-16269 | 1/1994 | (JP) . |
| 7-53062 | 2/1995 | (JP) . |
| 8-310680 | 11/1996 | (JP) . |
| 9-40191 | 2/1997 | (JP) . |
| 9-226964 | 9/1997 | (JP) . |
| 10-129868 | 5/1998 | (JP) . |

* cited by examiner

*Primary Examiner*—Christopher P. Ellis
*Assistant Examiner*—Kenneth W Bower
(74) *Attorney, Agent, or Firm*—Oliff & Berridge, PLC

(57) ABSTRACT

The invention relates to when the printing medium, such as paper are separated one at a time by a separation piece, the engagement of a projected part of a paper supporting plate and a contact part of a pressure applying part is released and the separation piece is pressed by a separation piece contact part. Thereby, the separation piece contacts the paper supplying roller with a large urging force from the first and second pressing springs. When the paper is transferred after the separation of the paper by the separation piece, the projected part of the paper supporting plate contacts the contact part of the pressure applying part to release the pressure of the separation piece from the separation piece contact part. Thereby, the pressure power generated between the paper supplying roller and the separation piece is selectively switched. When the paper is separated, the pressure power is increased to prevent overlapped transferring of the papers. When the paper is transferred by the transferring roller, the pressure power is decreased to decrease the back tension generated between the paper supplying roller and the transferring roller. Thereby, the deterioration of paper transferring accuracy can be prevented.

11 Claims, 15 Drawing Sheets

SHEET FEEDING DEVICE

BACKGROUND OF THE INVENTION

1. Field of Invention

The invention relates to a sheet feeding device for an image forming apparatus, and specifically relates to a sheet feeding device being capable of preventing overlapped feeding.

2. Description of Related Art

A sheet feeding device for feeding a sheet of printing medium, such as paper, into the inside of electronic apparatuses, is provided for electronic apparatuses having an image forming apparatus, such as a printer, a copier, or a facsimile device. In the feeding device, there has been known a feeding device provided with a frictional separating device for separating sheets of paper or the like, one at a time to feed the paper from a paper supplying roller. A separating piece then separates the sheets of paper one at a time through contact with the supplying roller.

The paper, which is fed one at a time by the frictional separating device, is fed in the paper transferring direction by the rotation of the supplying roller with a fixed pressure received from the sheet supplying roller and the separation piece. The paper is transferred to the inside of the electronic apparatus by the transferring roller provided in the lower stream side of the paper transferring direction. In the sheet feeding device of this structure, because of the back tension generated between the paper supplying roller and the transferring roller in supplying paper, paper is fed to the transferring roller side more than a predetermined transferring amount at the moment that the rear end of the paper is released from being held by the supplying roller and the separation piece. This back tension causes deterioration of the accuracy of transferring paper.

Therefore, the above-described deterioration of the accuracy of transferring paper is prevented by decreasing the pressure generated between the paper supplying roller and the separation piece, thereby decreasing the back tension between the paper supplying roller and the transferring roller.

However, by decreasing the pressure generated between the paper supplying roller and the separation piece, a great amount of paper may easily enter between the paper supplying roller and the separation piece and cause overlapped feeding, wherein a plurality of papers are unnecessarily transferred into the inside of the electronic apparatuses with the paper that is to be fed.

SUMMARY OF THE INVENTION

One aspect of the invention is to provide a sheet feeding device for selectively switching the pressure generated between the paper supplying roller and the separation piece with a simple structure, and thereby being capable of preventing overlapped feeding of paper by increasing the pressure in separating sheets of paper, and also being capable of preventing the deterioration of the accuracy of paper transfer by decreasing the pressure to decrease the back tension between the paper supplying roller and the transferring roller in transferring paper with the transferring roller.

Another aspect of the invention is to provide a sheet feeding device being capable of preventing overlapped feeding of paper that can be caused by decreasing the pressure in transferring the paper with the transferring roller.

To achieve the above-described aspect, the sheet feeding device of the invention may comprise a paper supporting part for storing a plurality of paper and being capable of positioning movably between a first position and a second position, a paper supplying roller provided in a lower side of the paper supporting part for supplying a paper in a predetermined direction, a separation piece for separating the stored papers one at a time with the paper supplying roller, an urging device for urging or pressing the separation piece toward the paper supplying roller, a switch for switching the urging force from the urging device between a first urging condition and a second urging condition that has a larger urging force than the first urging condition.

The urging device may comprise a first urging part for urging the separation piece with a predetermined urging force toward the paper supplying roller and a second urging part that is different from the first urging part. The switch may comprise a second urging part switch for switching the position of the second urging part from a position being cooperative with the first urging part, to a position being non-cooperative with the first urging part, so that the separation piece is urged only by an urging force of the first urging part in the first urging condition, and urged by an urging force of both the first urging part and the second urging part in the second urging condition.

In the structure, because the urging device may comprise two urging parts including the first urging part and the second urging part, the urging force for urging the separation part is switched between a large urging force and a small urging force by switching between a first urging condition using only the first urging part, and a second urging condition using both the first urging part and the second urging part.

The switching of the urging condition is operated in a condition that the first urging part can be always urged toward the paper supplying roller with a predetermined urging force and the switching of the urging condition is operated by only the movement of the second urging part by the second urging part switch. For example, when the paper is separated one at a time by the separation piece, the second urging part switch moves the second urging part in a position to be cooperative with the first urging part, and when the paper is transferred after the separation of the paper by the separation piece, the second urging part switch switches the second urging part to a position of being non-cooperative with the first urging part. Thus, the urging force for urging the separation piece toward the paper supplying roller is switched between the paper separating operation and the paper transferring operation. Therefore, the paper separating operation and the paper transferring operation can be carried out easily and accurately.

To achieve the above-described aspect, another sheet feeding device of the invention may comprise a paper supplying roller rotatable around a first axis for supplying paper in a predetermined direction, a separation piece for separating sheets of paper one at a time by contacting the paper supplying roller, an urging part for urging the separation piece toward the paper supplying roller, a separation piece moving away part for moving the separation piece away from the paper supplying roller against an urging force of the urging part, a second axis extended parallel to the first axis, and a pair of paper feeding back levers rotatable around the second axis in a vicinity of the separation piece, wherein after the rotation of the paper supplying roller stops by stopping an operation of the first axis, an operation of the second axis starts, and thereby the paper feeding back lever is rotated toward an upper stream side of the paper transferring direction so as to move the separation piece away from the paper supplying roller via the separation piece moving away part and the paper is fed back to the upper stream side of the paper transferring direction.

In the structure, during the separation of the separation piece and the paper supplying roller, the paper held between the separation piece and the paper supplying roller is fed back to the upper stream side of the paper transferring direction by the rotation of the paper feeding back lever. Thereby, the paper held between the separation piece and the paper supplying roller can be fed back to the upper stream side of the paper transferring direction without causing any burden on the paper.

Because the paper held by the separation piece and the paper supplying roller is removed, the sheets of paper are not piled between the separation piece and the paper supplying roller, and therefore, overlapped feeding can be well prevented. Because it is not necessary to increase the pressure power between the separation piece and the paper supplying roller so that the sheets of paper are not piled between the separation piece and the paper supplying roller, the back tension can be decreased. Because the paper feeding back lever is structured to be rotated around the second axis other than the paper supplying roller, the operation of the paper feeding back lever is not affected by the structure or the control of the paper supplying roller. Therefore, the paper feeding back lever does not use the same axis as the paper supplying roller for its rotation, so that the paper supplying roller is not rotated in accordance with the rotation of the paper feeding back lever and other unnecessary structure. Thus, any problems caused in the posture of the paper can be prevented using the structure of the invention.

BRIEF DESCRIPTION OF THE DRAWINGS

Further objects, details and advantages of the invention will be apparent from the following detailed description, when read in conjunction with the following drawings.

DETAILED DESCRIPTION OF PREFERRED EMBODIMENTS

Figure 1:
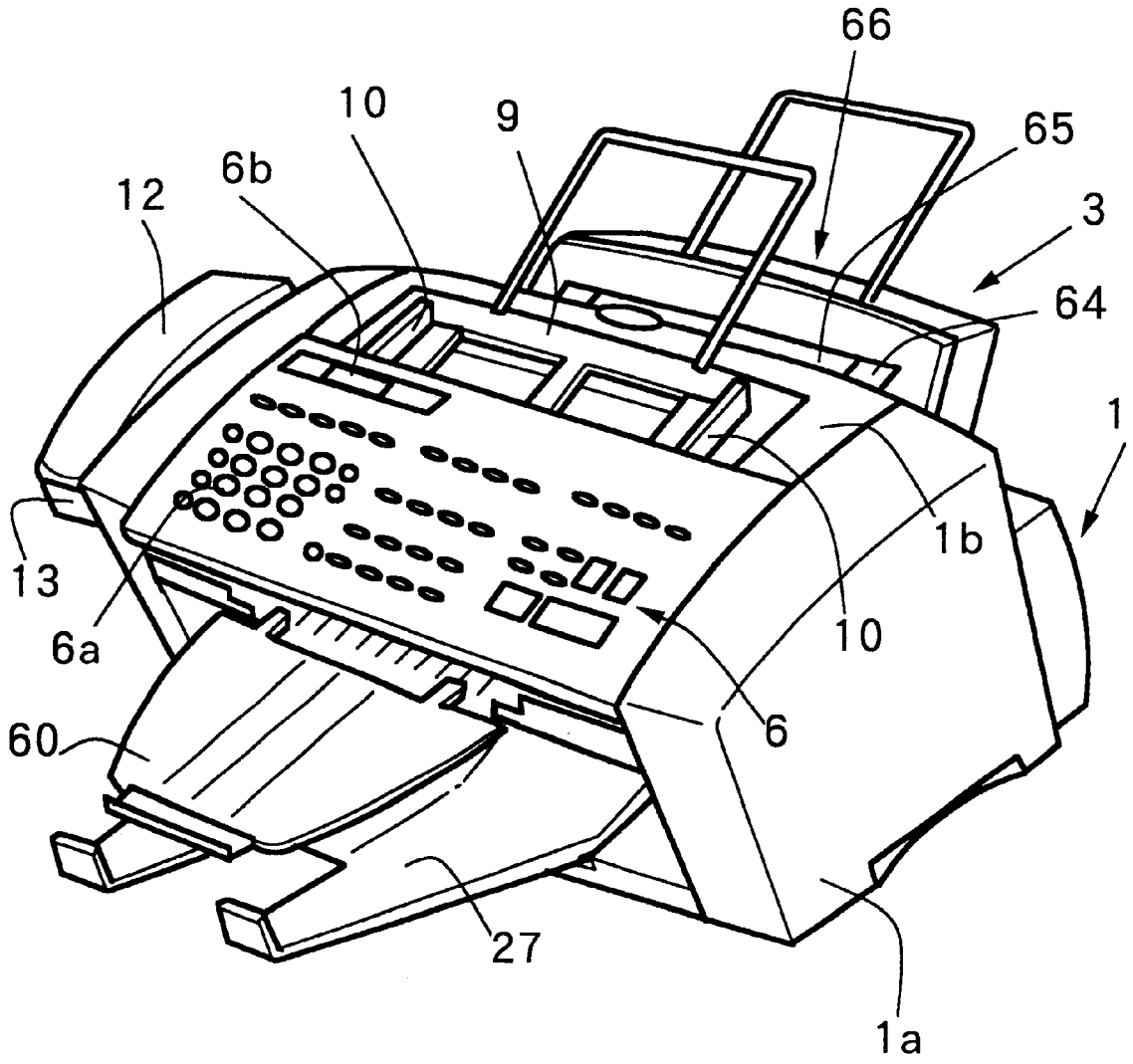
FIG. 1 is an outward appearance perspective view of the multi-function apparatus of the preferred embodiment.

The preferred embodiments will be explained referring the figures. FIG. 1 shows an outward appearance perspective view of a multi-function apparatus provided with the sheet feeding device of the invention. The multi-function apparatus 1 has various functions such as a facsimile function, a printer function, a copy function and a scanner function.

The multi-function apparatus 1 has a body case 1*a*, an upper cover 1*b*, a paper cassette 3, an operation panel 6, an original input tray 9, a paper discharge tray 27, an original discharge tray 60 and a sender/receiver 12.

In the multi-function apparatus 1, the operation panel 6, provided with a plurality of key switches 6*a* for inputting the above-described various function operation or telephone numbers and a liquid crystal display part 6*b* for displaying the operational state of the multi-function apparatus 1, is supported so as to open/close on the axis of the rear end of the operation panel 6 relative to the upper cover 1*b*. The upper cover 1*b* is supported so as to open/close on the axis of the front end of the upper cover 1*b* relative to the body case 1*a*.

The paper cassette 3, the paper discharge tray 27 being capable of storing a plurality of printed papers and a sender/receiver stand 13 for placing the sender/receiver 12, are installed in the body case 1*a*. The original placing part 9 being capable of receiving a plurality of originals, an original guide 10 being capable of sliding according to the size of the original, and the original discharge tray 60 being capable of receiving a plurality of originals that have been read, are provided to the upper cover 1*b*.

A paper insertion opening 66 for inserting a paper as a recording medium normally used by an user, a manual feeding paper placing stand 65, and a paper guide 64 being slidable according to the size of a manual feeding paper, are provided in the paper cassette 3.

Figure 2:
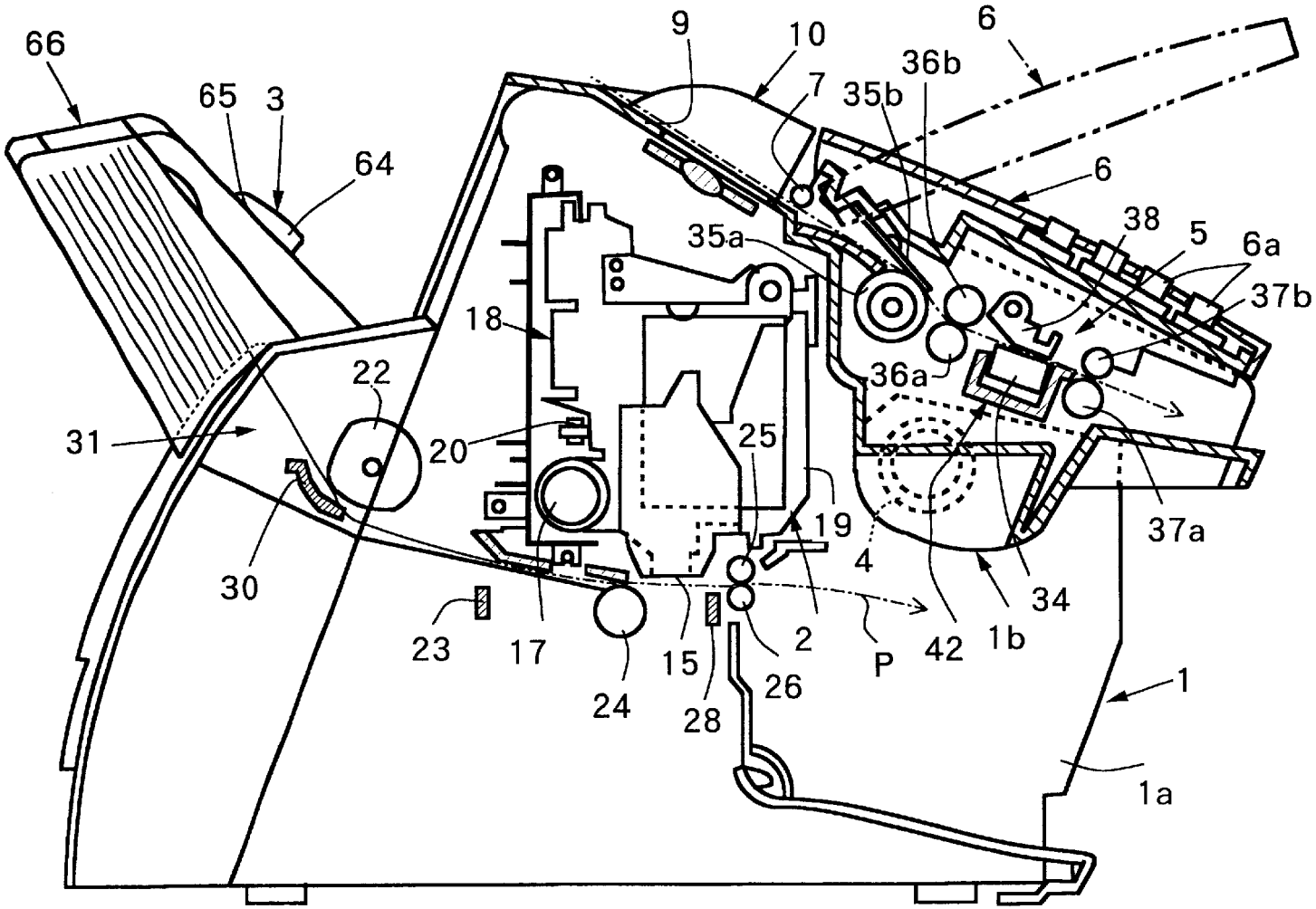
FIG. 2 is a cross sectional view of the center part of the multi-function apparatus taken along the paper transferring direction.

FIG. 2 is a cross sectional view of the center part of the multi-function apparatus 1 taken along the paper transferring direction. As shown in FIG. 2, a reading device 5 for reading lines of an original one by one where various information is written and a recording device 2 for printing information that is to be recorded, such as received data on a paper P, are provided in the multi-function apparatus 1.

The reading device 5 comprises, in an order from the upper side of the original transferring direction (the direction of the arrow in FIG. 2), the original placing part 9, an original separation piece 35*b*, an original supplying roller 35*a*, an original transferring driving roller 36*a*, an original transferring following roller 36*b*, an image reading scanner 34, an original pressing part 38, an original discharge driving roller 37*a*, and an original discharge following roller 37*b*.

In the above-structured reading device 5, originals placed on the original placing part 9 are separated one at a time by the original supplying roller 35*a* and the original separation piece 35*b* by restricting the position of the originals in their width direction using the original guide 10, and the separated original is transferred into the reading device 5. The original transferred into the reading device 5 is transferred to a reading part 42 by the original transferring driving roller 36*a* and the original transferring following roller 36*b* that are formed as an upper and lower pair. In the reading part 42, an image is read one line at a time when the transferred original is passed close to the image reading scanner 34. The image reading scanner 34 comprises a CIS (Contact Image Sensor) and an original pressing part 38 for pressing the original to the image reading scanner 24 to read the original. The original whose images have been read is transferred outside of the multi-function apparatus 1 by the original discharge driving roller 37*a* and the original discharge following roller 37*b* that are formed in an upper and lower pair, and placed on the original discharge tray 60 (referring FIG. 1). The pressing surface of the original pressing part 38 is formed with white-colored material and it is used as a standard color for detecting an end of the original and for the white color level.

The original separation piece 35*b*, the original transferring following roller 36*b* the original pressing part 38 and the original discharge following roller 37*b*, are provided on the rear surface of the operation panel 6, and the operation panel 6 is supported so as to open/close on an operation panel supporting axis 7 in a direction of opening the front end (the right side in FIG. 2) of the operation panel 6. Thereby, when the original is jammed in the original transferring route, the jammed original can be removed easily by opening the operation panel 6. The original placing part 9, the original supplying roller 35*a*, the original transferring driving roller 36*b*, the image reading scanner 34, and the original discharge driving roller 37*a*, are provided in the upper cover 1*b*, and the upper cover 1*b* is supported on an upper supporting axis 4 so as to open/close in a direction of opening the rear end (the left side in FIG. 2) of the upper cover 1*b*. Thereby, when an ink cartridge 19 used for an ink jet head is exchanged or a paper P is jammed, maintenance can be easily performed.

Next, the recording device 2 is explained in detail. The recording device 2 may include, in an order from the upper side of the paper transferring direction (the direction of the arrow in FIG. 2), the paper cassette 3, a separation mechanism 31, a carriage 18, a paper top end detecting sensor 23, a transferring roller 24, a paper rear end detecting sensor 28, the discharge driving roller 26 and the discharge following roller 25.

In the above-structured recording device 2, papers P inserted from the paper insertion opening 66 or papers placed on the manual feeding paper placing stand are separated one by one by the separation mechanism, and the separated paper is transferred into the multi-function apparatus 1. The paper P transferred into the multi-function apparatus 1 is transferred to a printing point by the transferring roller 24 after the transfer of the paper P is checked by the paper top end detecting sensor 23. A print head 15 for a color ink jet type is installed downwardly on the carriage 18 and the printing operation occurs by receiving power from a timing belt 20 to move the carriage 18 reciprocately on the guide shaft 17 extended in the paper width direction (the vertical direction in FIG. 2), and jetting ink onto the paper P. For executing color recording, four print heads 15 for jetting each color of cyan, yellow, magenta and black are installed in a row in the print head 15, and ink cartridges 19 for each color storing ink for supplying each corresponding print head 15, are installed detachably to the carriage 18. The printed paper P is transferred outside of the multi-function apparatus 1 by the discharge driving roller 26 and the discharge following roller 25 that are formed as an upper and lower pair. After the discharge of the paper P is checked by the paper rear end detecting sensor 28, the paper P is placed on the paper discharge tray 27 (referring FIG. 1).

Figure 3:
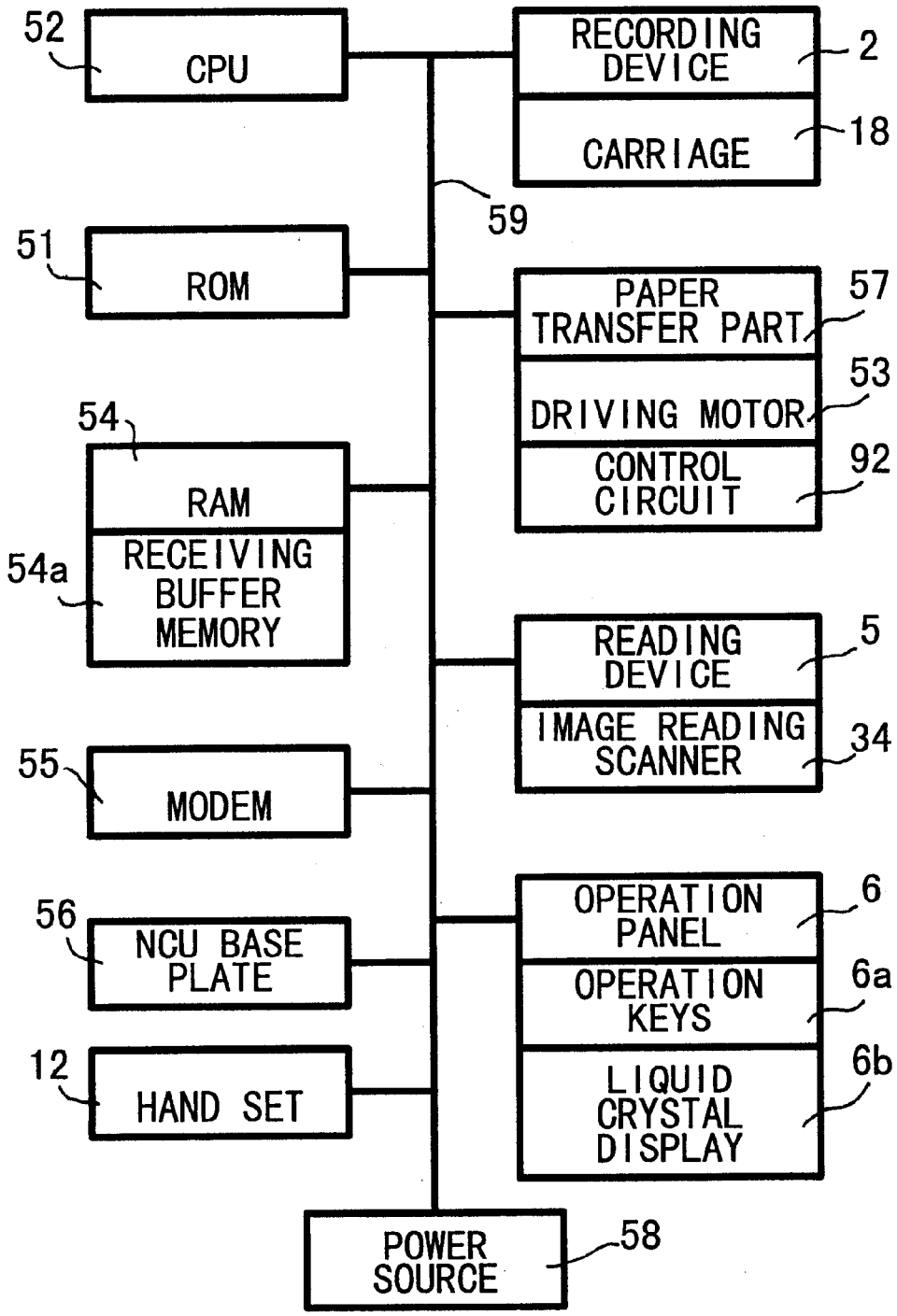
FIG. 3 is a block diagram of the control part for executing various functions provided in the multi-function apparatus.

FIG. 3 shows a block diagram of the control part for executing various functions provided with the multi-function apparatus 1. As shown in FIG. 3, the control part comprises CPU 52, ROM 51, RAM 54, a modem 55, an NCU base plate 56, a hand set 12, the printing device 2, a paper transfer part 57, the reading device 5, the operation panel 6 and a power source part 58. In the above-structured control part, the following components are connected with each other via bus lines 59, that include CPU 52 for executing various controls and arithmetic, ROM 51 storing control programs for ordering various control operation, RAM 54 a part of which is used as a receiving buffer memory 54*a*, the NCU base plate 56 for communicating with other communication devices, the modem 5 for sending/receiving communication data between other communication devices via the NCU base plate 56, the handset 12 for conversing with other telephone devices, the printing device 2 provided with the carriage 18 mounting the print head 15, the paper transfer part 57 provided with the driving motor 53 for driving each paper transferring roller and a control circuit 92 for controlling the driving of the driving motor 53, the reading device 5 provided with an image reading scanner 34 for reading one line at a time in the paper width direction, the operation panel 6 provided with the operation keys 6*a* and the liquid crystal display 6*b*, and the power source part 58 for supplying a power source to the multi-function apparatus 1.

Figure 4:
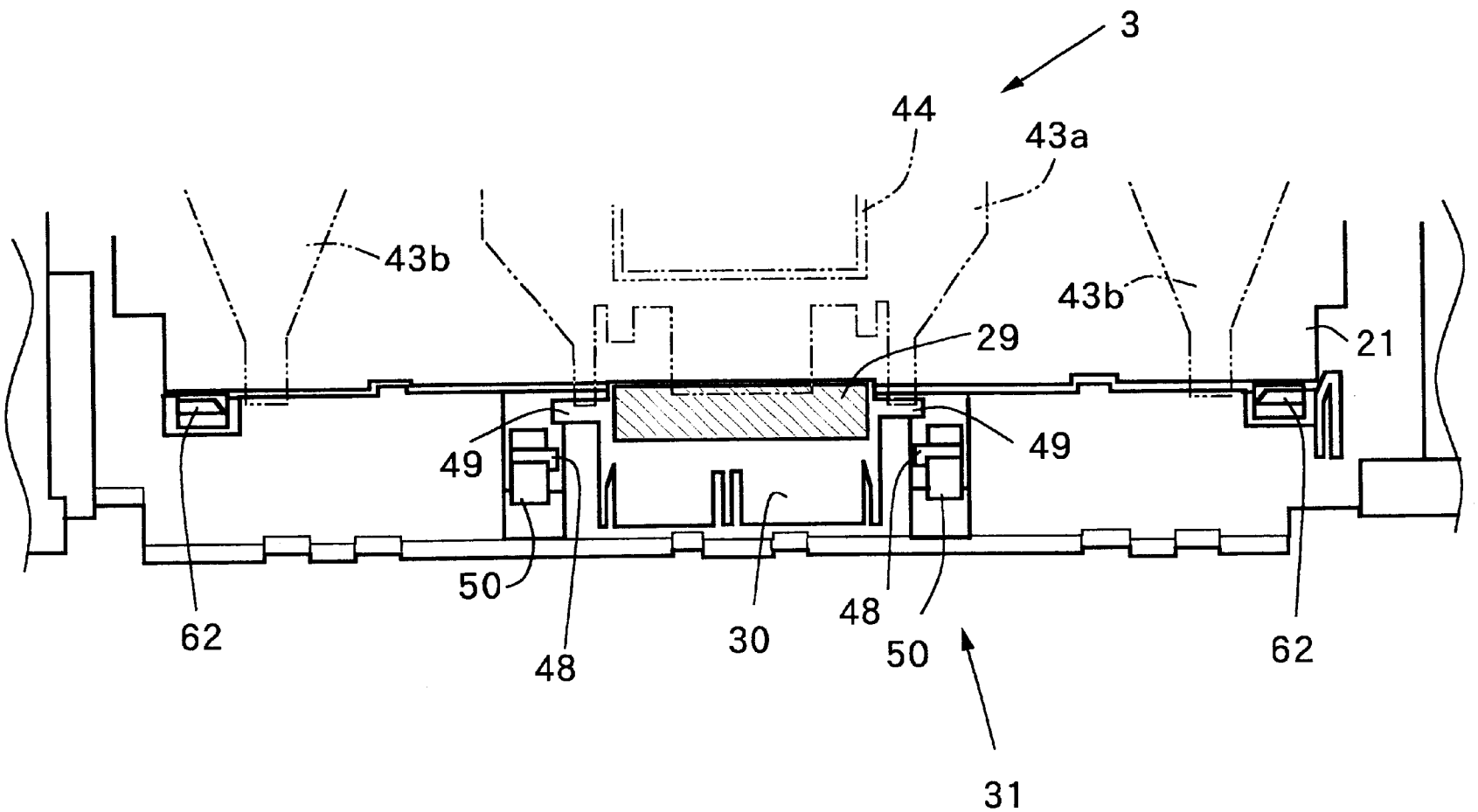
FIG. 4 is a plane view of the separation mechanism seen from the upper side.
Figure 5:
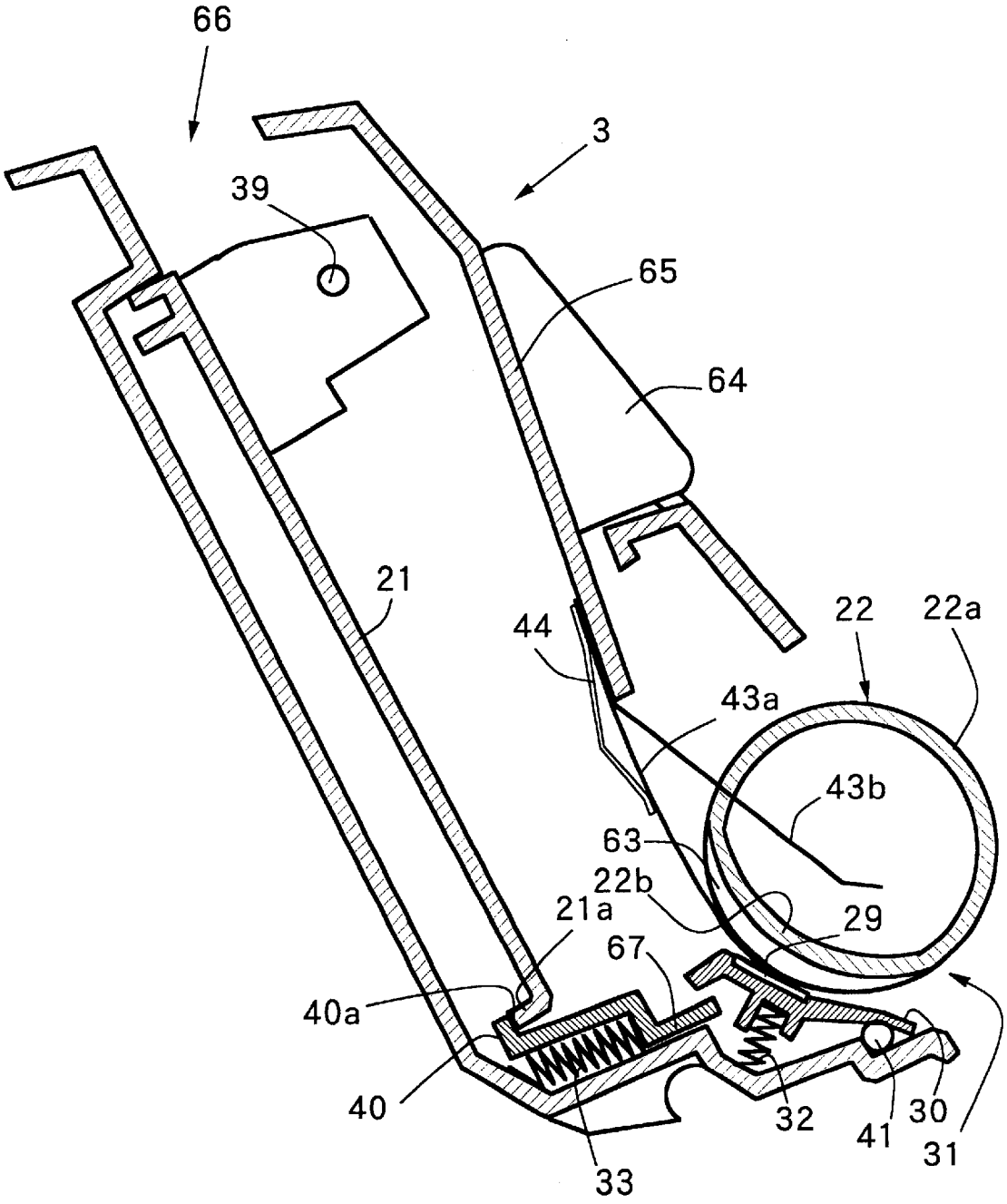
FIG. 5 is a cross sectional view of the separation mechanism seen from the side.
Figure 6:
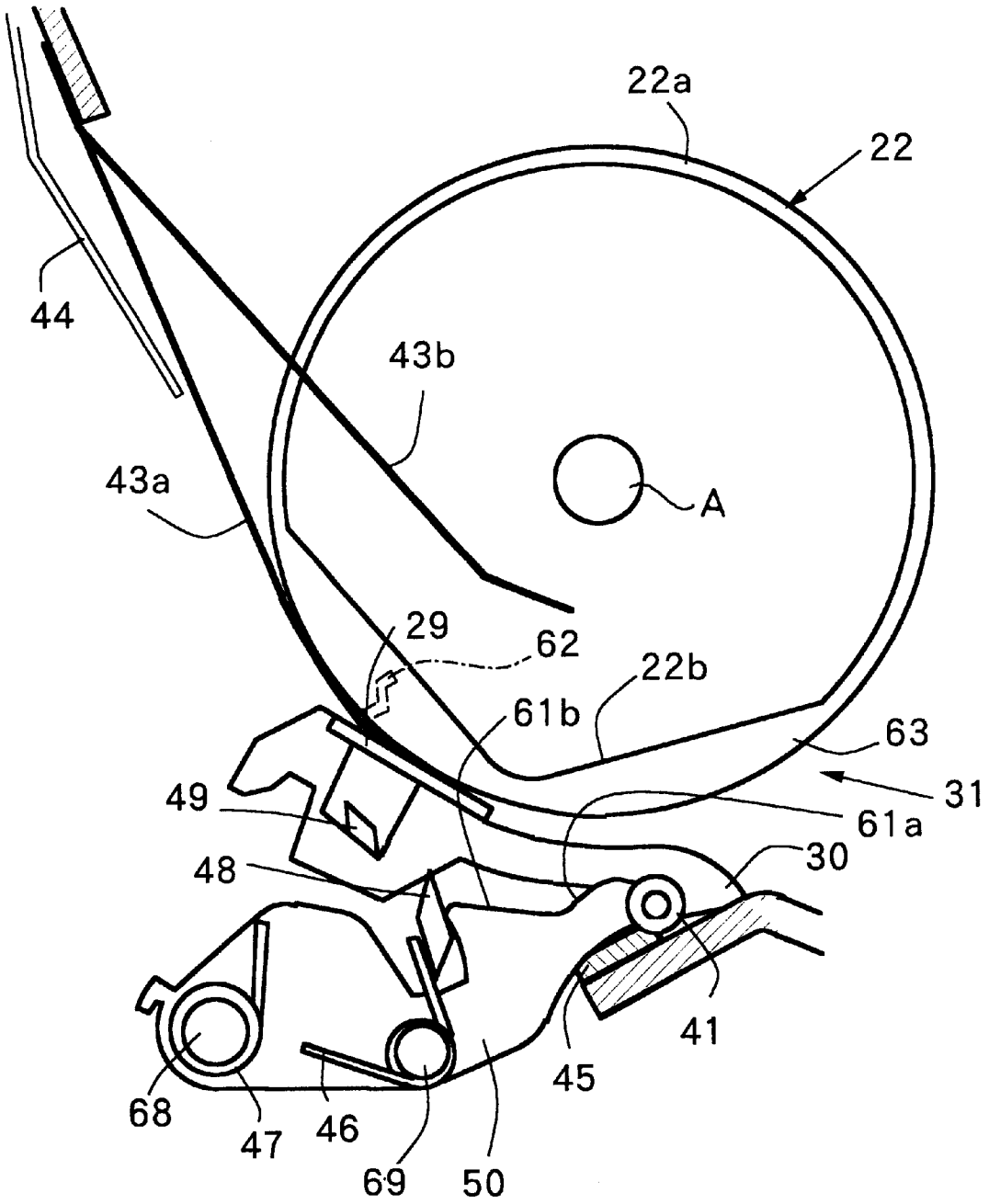
FIG. 6 is a main part magnified cross sectional view of the main part of separation mechanism.

The above-described separation mechanism 31 is explained in detail referring FIGS. 4–6. FIG. 4 is a plane view of the separation mechanism 31 seen from the upper side, FIG. 5 is a cross sectional view of the separation mechanism 31 seen from the side, and FIG. 6 is a main part magnified cross sectional view of the main part of the separation mechanism 31.

As shown in FIG. 4, the separation mechanism 31 may include, in an order from the upper stream of the paper transferring direction (direction from the lower side to the upper side in FIG. 4), a paper supporting plate 21 where 200 papers P at the maximum can be placed, a first manual paper feeding film 43*a* installed on the manual feeding paper placing stand 65 (referring FIG. 5) and for guiding the center of the manual feeding paper in its width direction in the paper transferring direction, a second manual paper feeding film 43*b* for guiding the both sides of the manual feeding paper in the direction of the manual feeding, a film urging wire 44 for urging the first manual paper feeding film 43*a* in an upper direction, a separation claw 62 placed on the both sides of the paper, the separation piece 30 for pressing the paper P to the side of the paper supplying roller 22 (referring FIG. 5), and a paper feeding back lever 50 for pushing back the paper P to the upper side in the paper transferring direction. The separation piece 30 comprises a separation pad 29 for separating papers one by one with the rotational power of the paper supplying roller 22 and a separation projected part 49 projected from the separation piece 30 in its longitudinal direction. A separation pressing lever 48 engageable with the separation projected part 49 is provided to the paper feeding back lever 50.

Next, the structure of the separation mechanism 31 seen from its side with reference to FIGS. 5 and 6. Note that the above-described paper feeding back lever 50 is not described in FIG. 5, but is shown in FIG. 6.

As shown in FIG. 5, the paper supporting plate 21 is supported to be rotatable around the supporting axis 39 by the rotation mechanism and an projected part 21*a* projecting toward the lower side is formed in the lower end side of the paper transferring direction (lower direction in FIG. 5). The separation piece 30 is supported to be rotatable around a separation piece supporting axis 41 and the separation piece 30 is always urged toward the paper supplying roller 22 side via a first pressing spring 32. A pressure applying part 40 comprises a separation piece contacting part 67 being able to urge the separation piece 30 toward the paper supplying roller 22 side using a second pressing spring 33, and a contacting part 40*a* formed on the other end from the separation piece contacting part 67 that is able to contact the projected part 21*a*. The first manual paper feeding film 43*a* is formed so as to guide the manual feeding paper placed on the manual feeding paper placing stand 65 toward a separation point between the separation piece 30 and the paper supplying roller 22. The second manual paper feeding film 43*b* is formed so as to guide the both ends of the manual feeding paper toward the upper direction. The urging force of the first pressing spring 32 is set so that a plurality of papers placed slanted on the paper supporting plate 21 press the separation piece 30 using their own weight to prevent the unnecessary insertion of the papers into the paper supplying roller 22 side. The urging force of the second pressing spring 33 is set larger than that of the first pressing spring 32. In the preferred embodiment, the urging force of the first pressing spring 32 is set to 100 g and that of the second pressing spring 33 is set to 200 g.

The paper supplying roller 22 is rotated in accordance with the rotation of a roller axis A (referring FIG. 6) and has a fan-shaped paper supplying part 22*a* having an arc surface contacting the paper P and a non-paper supplying part 22*b* having a surface not contacting the paper P. The paper supplying roller 22 is structured to supply papers one at a time to the transferring roller 24 (referring FIG. 2) through contact of the paper supplying part 22*a* with the upper surface of the paper P. A round-shaped paper supplying roller 63 is provided on the same axis of the paper supplying roller 22, therefore, the papers P piled on the paper supporting plate 21 are not inserted between the separation piece 30 and the non-paper supplying part 22*b* even in the position that the separation piece 30 faces the non-paper supplying part 22*b* because the paper supplying roller 63 always contact the separation piece 30. The arc surface of the paper supplying part 22*a* is formed so that its length of the arc is enough for transferring a paper P from the paper supplying roller 22 to the transferring roller 24, and paper is transferred through one rotation of the paper supplying roller 22.

As shown in FIG. 6, the paper feeding back lever 50 is supported so as to be rotated around the paper feeding back lever supporting axis 68 (the second axis) that is extended in the opposite side of the roller axis A placing the separation piece 30 therebetween, and the paper feeding back lever 50 is urged in a direction toward the opening the paper feeding route (in the clockwise direction in FIG. 6) by the second coil spring 47. When the paper feeding back lever 50 is rotated around the paper feeding back lever supporting axis 68 in a counterclockwise direction, the separation piece pressing lever 48 engageable with the separation piece projected part 49 formed on the separation piece 30 is supported rotatably to the separation pressing lever supporting axis 69 and the separation piece pressing lever 48 is urged in a clockwise direction by the first coil spring 46. Further, the paper feeding back lever 50 has a first paper contact surface 61*a* and a second paper contact surface 61*b* for pressing back the paper P to the upper stream side of the paper transferring direction. The rotation of the paper feeding back lever 50 in the clockwise direction is restricted in a predetermined range by a noise reduction pad 45 provided on the paper cassette 3. The separation piece projected part 49 is provided on the both left and right sides of the separation piece 30 and the paper feeding back lever 50 is provided in two points corresponding to them.

Figure 12:
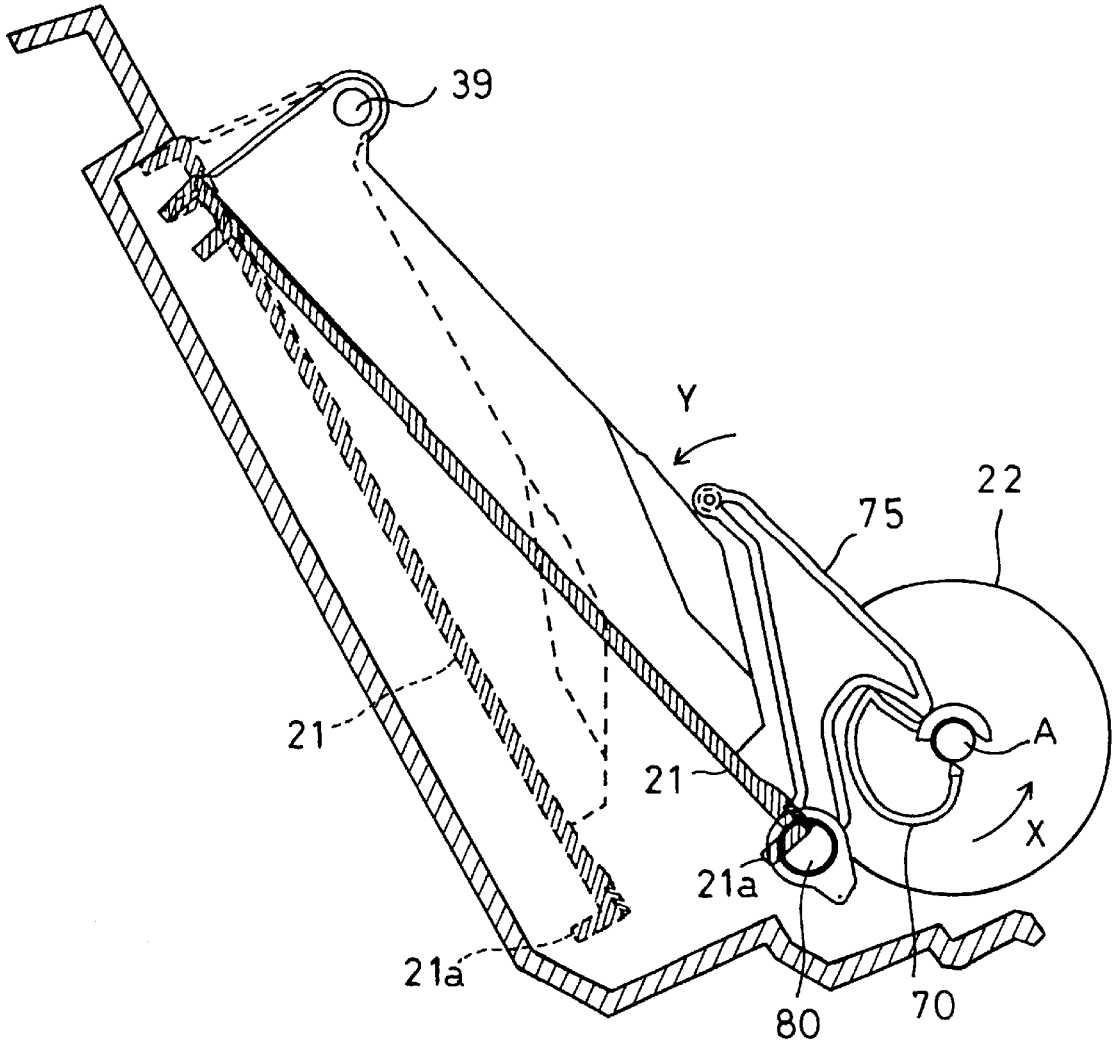
FIG. 12 is an explanation view of the rotation mechanism of the paper supporting plate.
Figure 13A:
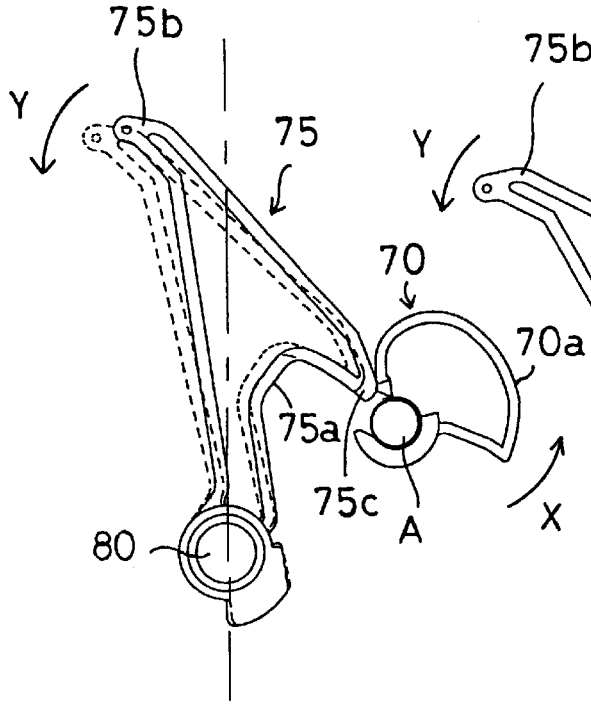
FIG. 13 is an explanation view of the rotation mechanism of the paper supporting plate.
Figure 13B:
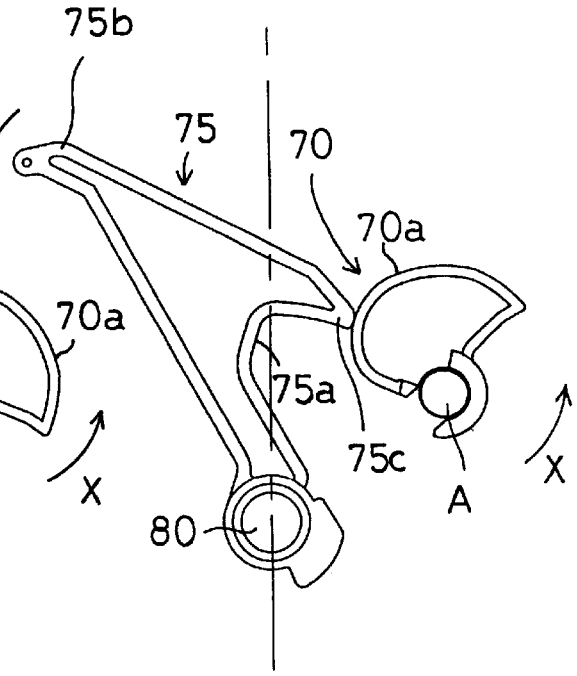
Figure 13C:
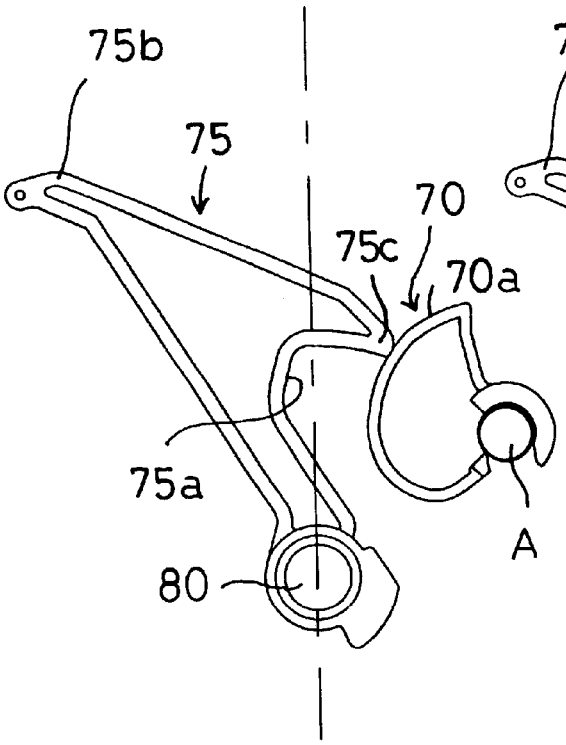
Figure 13D:
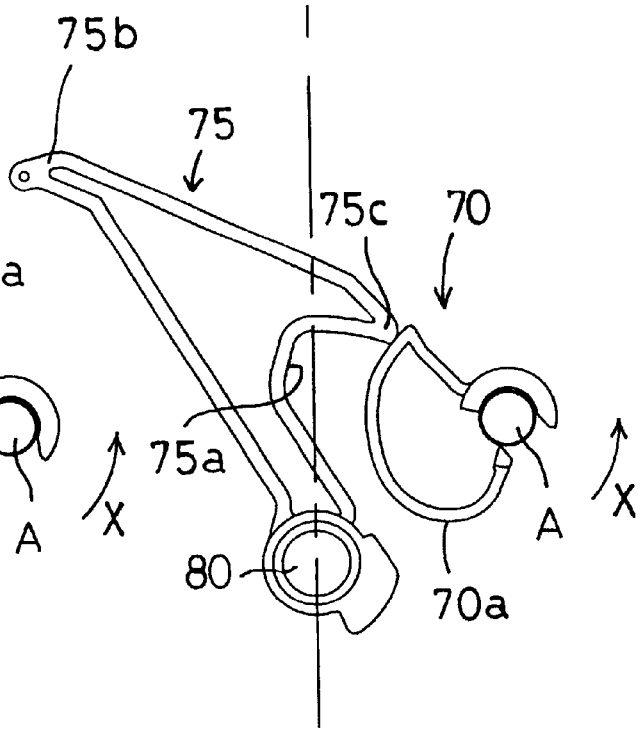
Figure 14:
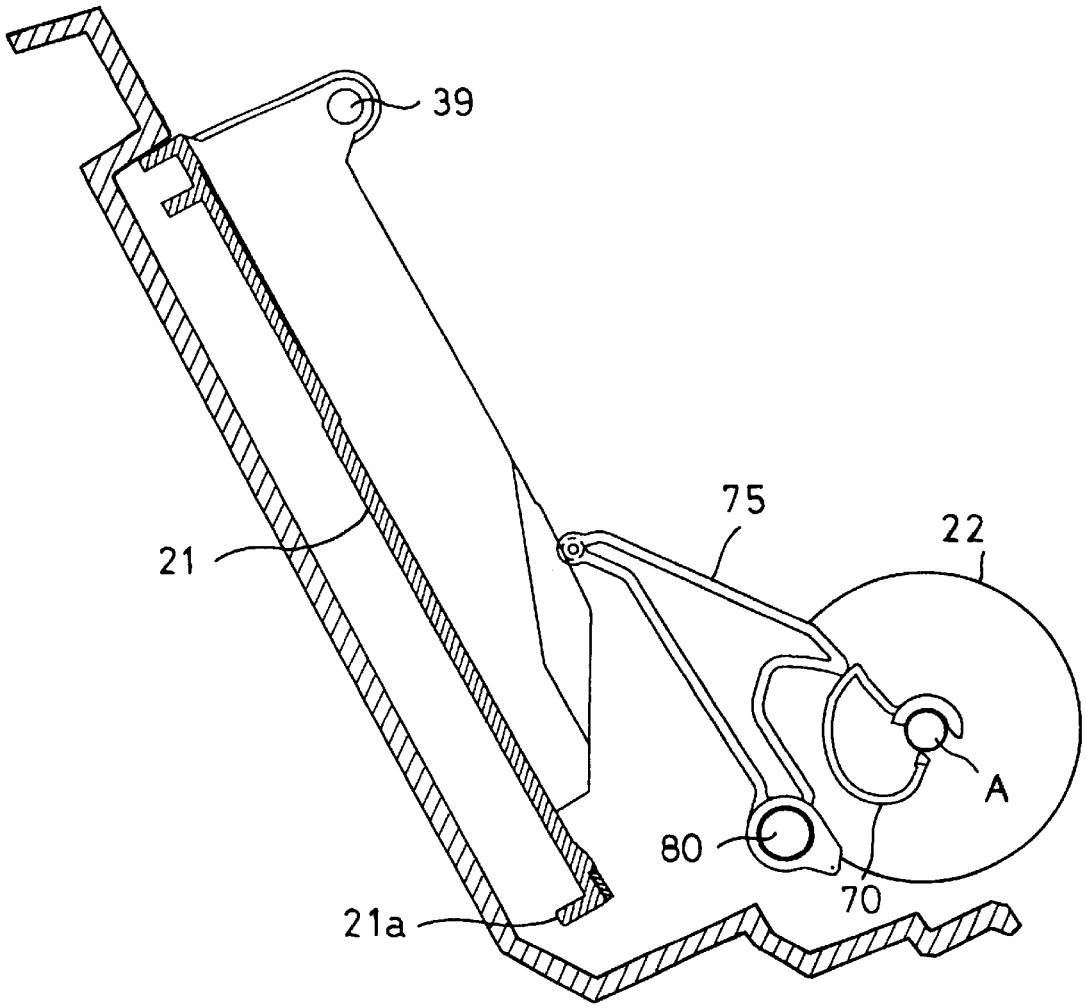
FIG. 14 is an explanation view of the rotation mechanism of the paper supporting plate.

The rotation mechanism of the paper supporting plate 21 is explained by referring FIGS. 12–14. In FIGS. 12–14, the separation piece 30, the first pressing spring 32, the second pressing spring 33 and pressure applying part 40 are omitted.

As shown in FIG. 12, when the paper supporting plate 21 does not receive the power from the rotation mechanism, the top end side (the projected part 21*a* side) of the paper supporting plate 21 is urged toward the paper supplying roller 22 by an urging part such as a compressed spring (not shown) that is provided on the rear side of the paper supporting plate 21, and the paper supporting plate 21 is rotated around the supporting axis 39 in the counterclockwise direction to the solid-lined position and maintained there. When the paper supporting plate 21 receives the power from the rotation mechanism, the paper supporting plate 21 is rotated against the urging force of the urging part in the clockwise direction and moves back to the a dotted-lined position in FIG. 12. The paper supporting plate 21 is formed to be movable between the solid-lined position (second position) and the dotted-lined position (first position) by the rotation mechanism.

As shown in FIG. 12, as same as the paper supplying roller 22 the rotation mechanism comprises a cam 70 being rotatable around and with the roller axis A and the paper supporting plate pressing lever 75 provided facing the cam 70. The cam 70 has a cam surface 70*a* for controlling substantially the movement timing of the paper supporting plate 21. The paper supporting plate pressing lever 75 is provided closely on the upper surface of the paper supporting plate 21. The paper supporting plate pressing lever 75 has a concave part 75*a* engaged with the cam 70, a lever part 75 for pressing the paper supporting plate 21 and a contact part 75*c* contacting the cam surface 75*a*. The paper supporting plate pressing lever 75 is rotated around the rotation axis 80 in response to the power from the cam 70. In the preferred embodiment, the rotation mechanism is provided on the both left and right sides of the paper supporting plate 21 and the rotation axis 80 is uniformly formed with the paper cassette 3 for rotating the paper supporting plate 21 accurately. As shown in FIG. 12, a side wall 21*b* is provided on the left and right sides of the paper supporting plate 21 and the lever part 75*b* presses the side walls 21*b*.

As shown in FIG. 12, because a predetermined space between the cam surface 70*a* and the concave part 75*a* in a condition that the cam surface 70*a* of the cam 70 is completely engaged with the concave part 75*a* of the paper supporting plate pressing lever 75, the paper supporting plate pressing lever 75 does not receive power from the cam 70. Therefore, the paper supporting plate 21 is not affected by the operation of the rotation mechanism and the power to operate the paper supporting plate 21 is only an urging force by the urging part (not shown) and the paper supporting plate 21 is in a condition that its top end is placed on the paper supplying roller 22 side (the second position).

When the cam 70 rotates in the arrow X direction in FIG. 12 according to the rotation of the roller axis A, the cam surface 70*a* is gradually released from the concave part 75*a*. At this time, the cam surface 70*a* and the concave part 75*a* do not contact by the space formed therebetween and the rotation of the paper supporting plate pressing lever 75 is prevented.

When the cam 70 continues the rotation in the arrow X direction, one end of the cam surface 70*a* starts to contact the contact part 75*c* (FIG. 13(*a*) ), the contact part 75*c* is guided along the curved surface of the cam surface 70*a* and the paper supporting plate pressing lever 75 is rotated in the arrow Y direction in FIG. 13(*b*). According to the rotation of the paper supporting plate pressing lever 75, as the lever part

75*b* starts to press the paper supporting plate 21 (FIG. 13(*c*) ), a space begins to form between the paper supporting plate 21 and the paper supplying roller 22.

FIG. 14 shows the condition of the paper supporting plate 21 when the other side of the cam surface 70*a* contacts the contact part 75*c* of the paper supporting plate pressing lever 75, as shown in FIG. 13(*d*). In this condition, the space formed between the paper supporting plate 21 and the paper supplying roller 22 becomes maximum. The positioning of the paper supporting plate 21 shown in FIG. 14 corresponds to the dotted-line (the first position) in FIG. 12. When the cam 70 further rotates, the contact between the contact part 75*c* and the cam surface 70*a* is released and the cam surface 70*a* is guided to engage with the concave part 75*a* again, and thereby the paper supporting plate pressing lever 75 is rotated in the direction opposite to the arrow Y direction and back to the condition of FIG. 12. Thereby, the pressing condition of the paper supporting plate 21 is released. The series of operations is repeated by the rotation of the cam 70.

The reciprocate movement of the paper supporting plate 21 is related to the pressure applying part 40. As described above, when the paper supporting plate 21 is rotated in the clockwise direction, the projected part 21 a of the paper supporting plate 21 is also rotated to contact the contact part 40*a* of the pressure applying part 40 and the contact part 40*a* is moved away from the separation piece 30 against the urging force of the second pressing spring 33. On the contrary, when the paper supporting plate 21 is rotated in the counterclockwise direction, the projected part 21*a* of the paper supporting plate 21 is also rotated to move away from the contact part 40*a* of the pressure applying part 40 and the pressure applying part 40 moves back to the separation piece 30 side by the urging force of the second pressing spring 33.

The operation of the rotation of the paper supporting plate 21 in supplying a paper and the movement of the pressure applying part 40 caused thereby are explained in detail below.

Figure 8:
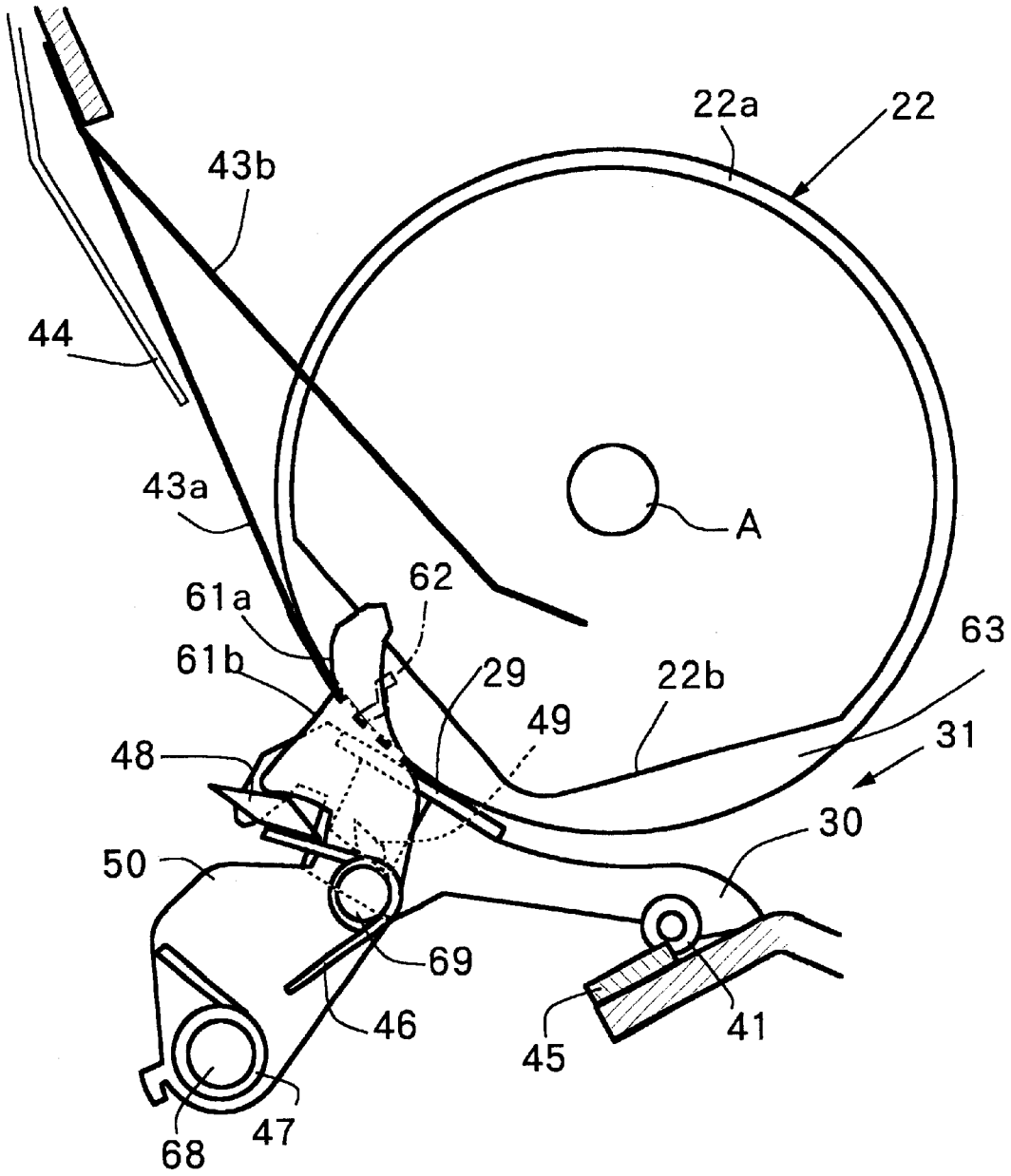
FIG. 8 is a view showing the third stage of the paper ordering operation.
Figure 9:
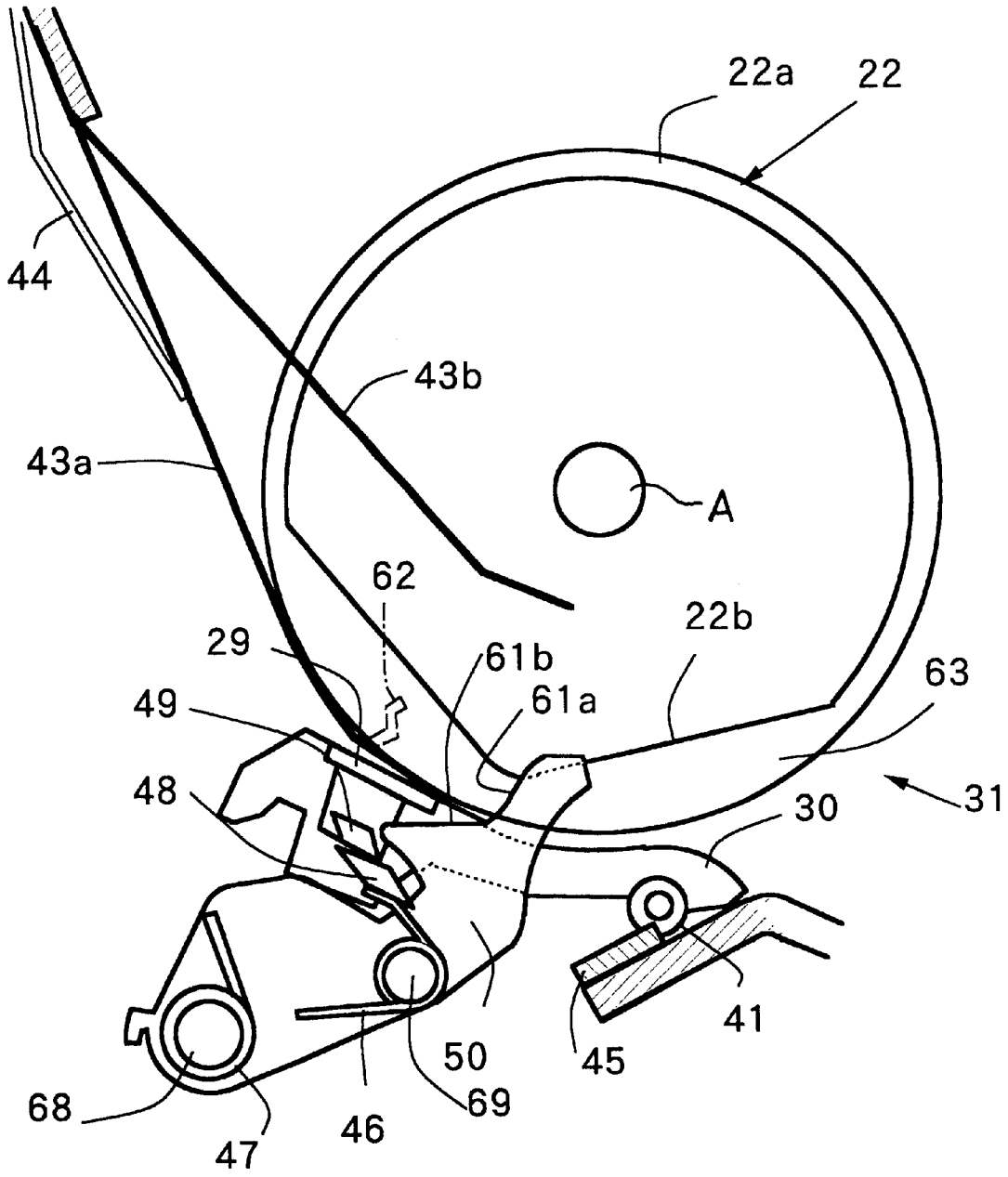
FIG. 9 is a view showing the fourth stage of the paper ordering operation.
Figure 10:
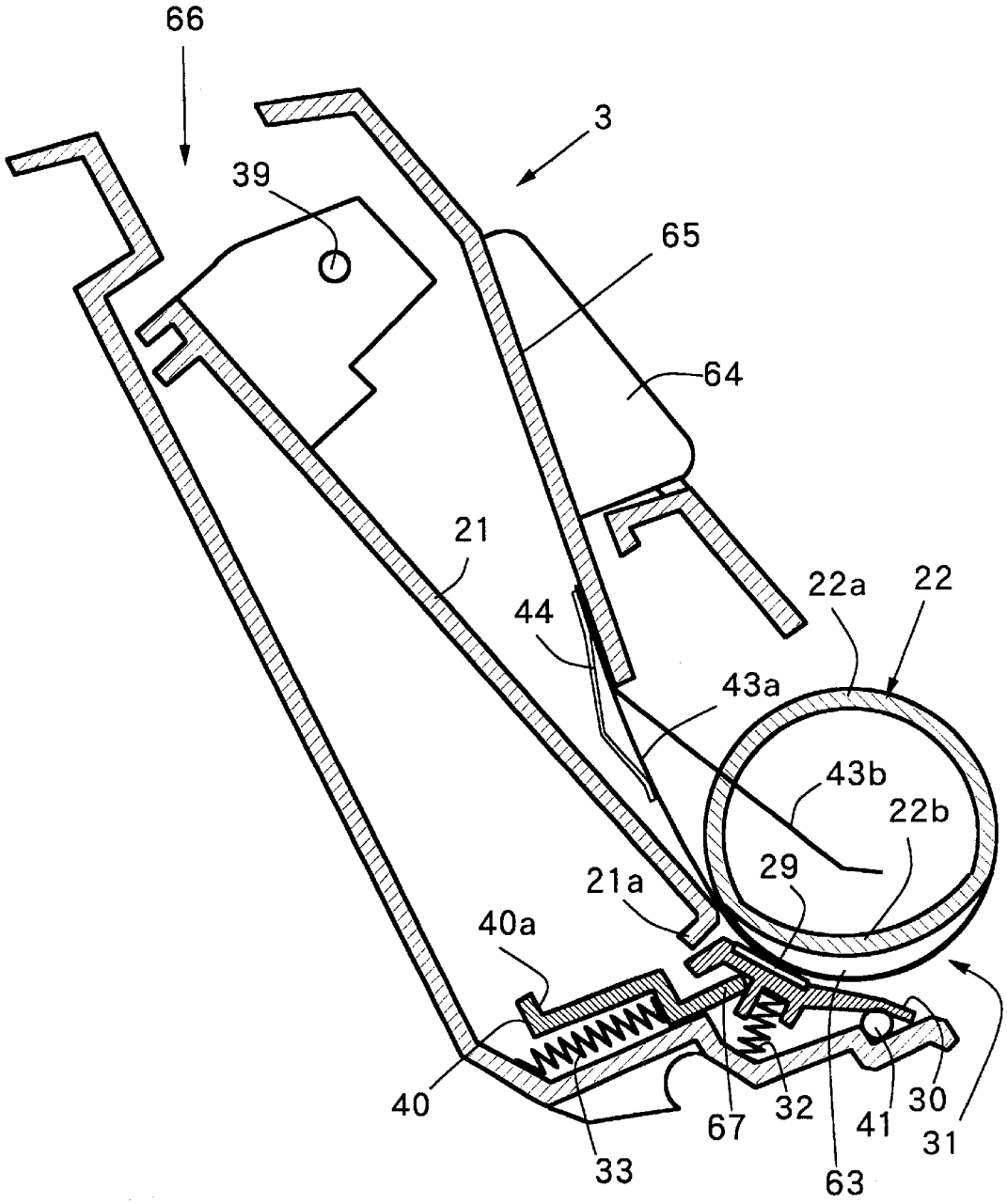
FIG. 10 is a view showing the second stage of the separating operation carried out after execution of the paper ordering operation.
Figure 11:
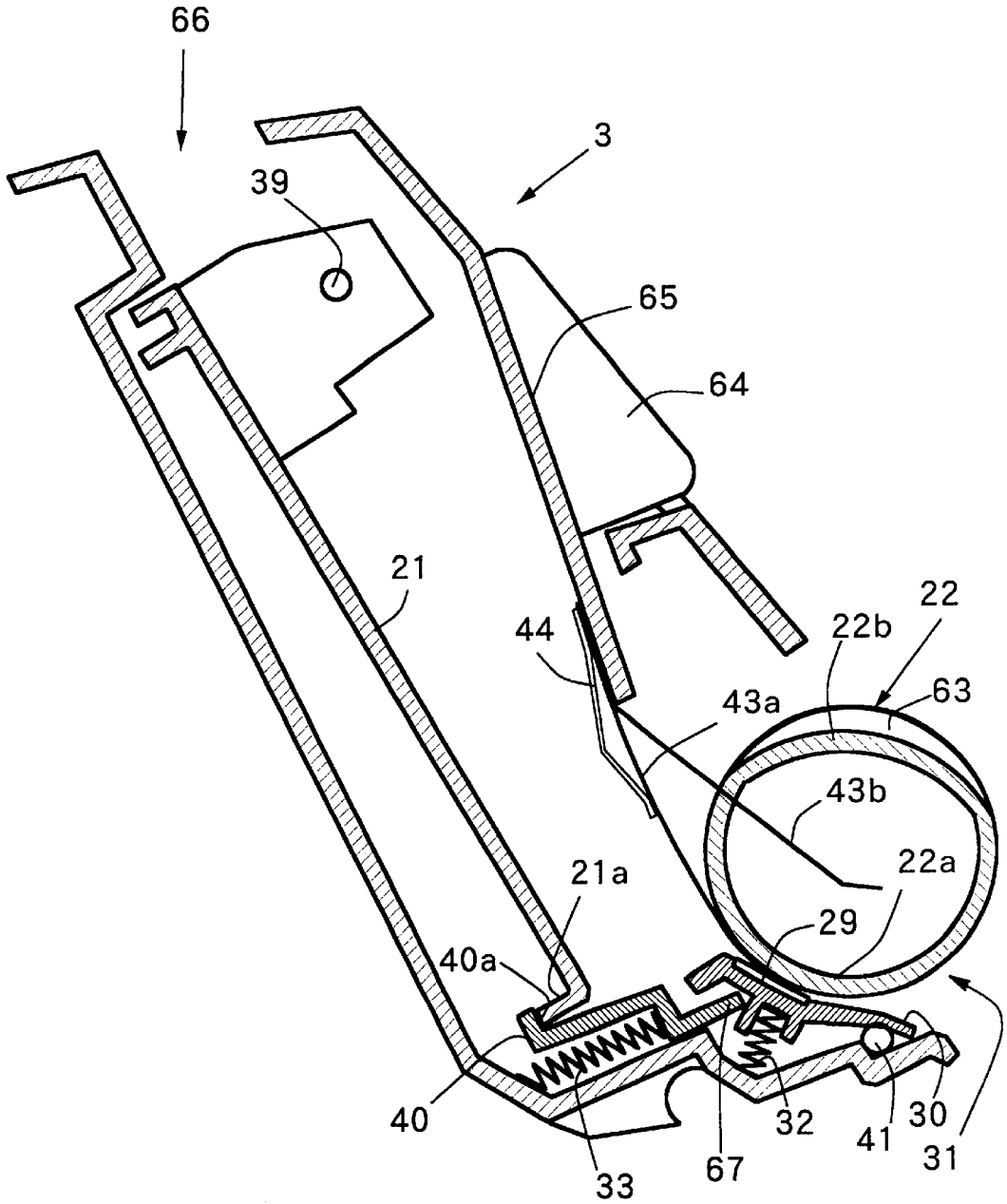
FIG. 11 is a view showing the third stage of the separating operation.

Out of the paper supplying operation for supplying sheets of paper, and the like, P one at a time into the multi-function apparatus 1 by the above-structured separation mechanism 31, the separating operation (referring FIGS. 5, 10 and 11) for separating the papers P one at a time and the paper ordering operation (referring FIGS. 6–9) for ordering paper in a predetermined condition every time the sheets of paper P are separated one at a time are explained in detail referring FIGS. 5–11. The paper supplying operation shown in FIGS. 5–11 is in a loop, and from the initial condition of the separation mechanism 31 shown in FIG. 5, the paper ordering operation shown in FIGS. 6–9 and the separating operation shown in FIGS. 10 and 11 are carried out. The paper supplying operation then returns back to the initial condition of the separating operation shown in FIG. 5 for supplying a paper P.

In the initial condition shown in FIG. 5, the paper supporting plate 21 is rotated around the supporting axis 39 to the end in the clockwise direction (the bottom dead point) and a space is formed between the paper supporting plate 21 and the paper supplying roller 22 for inserting papers P. The rotation mechanism at this time is in a condition shown in FIGS. 13(*d*) and 14 where the paper supporting plate pressing lever 75 is rotated in response to the power from the cam 70 to press the paper supporting plate 21. Thereby, the projected part 21*a* provided on the paper supporting plate 21 contacts the contact part 40*a* of the pressure applying part 40 and the pressure applying part 40 is pressed down against the urging force of the second pressing spring 33. In the initial condition of the separating operation, the contact between the separation piece 30 and the separation piece contact part 67 is released by the pressing down of the pressure applying part 40, and only the pressure by the first pressing spring 32 is applied to the separation piece 30 (the first urging condition). In the initial condition of the separating operation, the non-paper supplying part 22*b* of the paper supplying roller 22 faces the separation piece 30 and the paper supplying roller 63 contacts the separation pad 29.

In the initial condition of the separating operation shown in FIG. 5, when the paper supplying order is applied by CPU 52, the separation mechanism 31 first feeds back to the upper stream side of the paper transferring direction, a paper P that remains between the paper supplying roller 22 and the separation piece 30 at the last paper supplying operation to carry out the paper ordering operation for ordering papers P. The paper ordering operation is explained in detail referring FIGS. 6–9 as follows.

The above-described initial condition of the paper ordering operation is shown in FIG. 6. As shown in FIG. 6, the paper feeding back lever 50 is rotated around the paper feeding back lever supporting axis 68 to the end in the clockwise direction (the dead bottom point), the paper feeding back lever 50 contacts the noise reduction pad 45.

Figure 7:
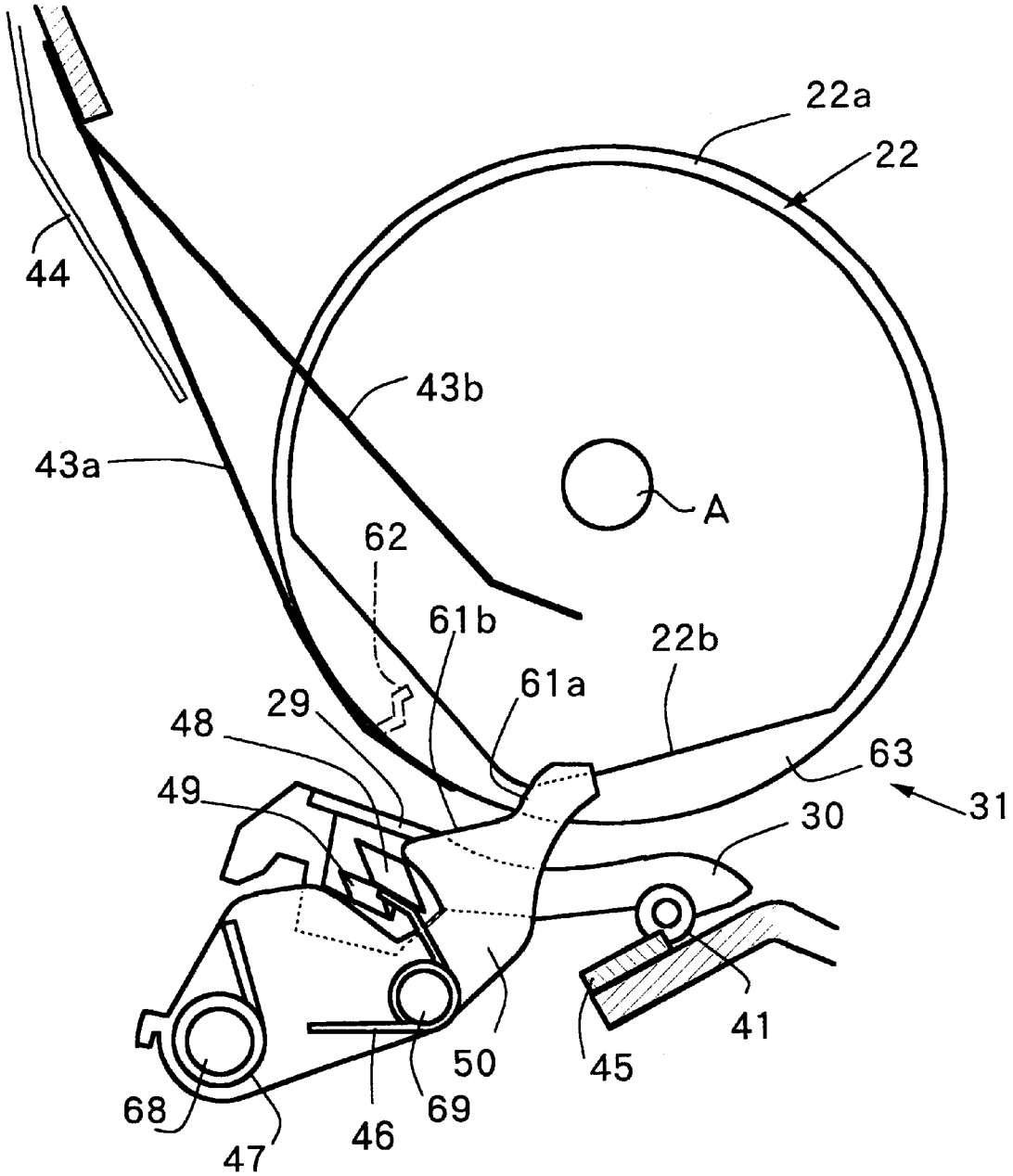
FIG. 7 is a view showing the second stage of the paper ordering operation.

FIG. 7 shows the second stage of the above-described paper ordering operation. As shown in FIG. 7, the paper feeding back lever supporting axis 68 (the second axis) and the paper feeding back lever 50 are rotated in the counterclockwise direction from the initial condition of paper ordering operation shown in FIG. 6, and the separation piece pressing lever 48 is engaged to the upper part of the separation piece projected part 49. At this time, because the separation piece pressing lever 48 is structured so as to press down the separation piece 30 against the urging force of the first pressing spring 32, the paper supplying roller 63 does not contact the separation pad 29 to release the pressure applied to the paper P held by the paper supplying roller 63 and the separation pad 29. In the operation from the initial condition to the second stage of paper ordering operation, the paper P that is released from the pressure by the paper supplying roller 63 and the separation pad 29, is fed back to the upper stream side of the paper transferring direction by the rotation of the paper feeding back lever 50 in the counterclockwise direction with maintaining the angle formed by the top end of the paper P and the first paper contact surface 61*a* at a right angle.

FIG. 8 shows the third stage of the above-described paper ordering operation. As shown in FIG. 8, the paper feeding back lever 50 is further rotated in the counterclockwise direction from the second stage of the paper ordering operation shown in FIG. 7 to release the engagement of the separation piece pressing lever 48 and the separation piece projected part 49. FIG. 8 also shows a condition that the paper feeding back lever 50 is rotated around the paper feeding back lever supporting axis 68 to the end (the dead bottom point). As a result of the release of the engagement of the separation piece pressing lever 48 and the separation piece projected part 49, the separation piece 30 is structured so that the separation pad 29 contacts the paper supplying roller 63 by the urging force of the first pressing spring 32. In the operation from the second stage to the third stage of the paper ordering operation, the paper P that is released from the pressure by the paper supplying roller 63 and the separation pad 29 is fed back to the upper stream side of the paper transferring direction by the rotation of the paper feeding back lever 50 in the counterclockwise direction by maintaining the angle formed by the top end of the paper P and the second paper contact surface 61*b* at a right angle.

FIG. 9 shows the fourth stage of the above-described paper ordering operation. As shown in FIG. 9, the paper feeding back lever 50 is rotated in the clockwise direction from the third stage of the paper ordering operation shown in FIG. 8 and the separation piece pressing lever 48 is engaged to the lower part of the separation piece projected part 49. At this time, because the separation piece pressing lever 48 is structured so as to be pressed down around the separation piece pressing lever 69 as a center axis by the separation piece projected part 49 against the urging force of the first coil spring 46, the separation piece pressing lever 48 can pass smoothly below the separation piece projected part 49 without releasing the pressure by the paper supplying roller 63 and the separation pad 29. After the fourth stage of the paper ordering operation, the paper feeding back lever 50 continues the rotation in the clockwise direction to return to the initial condition of the paper ordering operation and finish the above-described paper ordering operation. At this time, the paper feeding back lever 50 is rotated in the clockwise direction by the urging force of the second coil spring 47, however, because the rotation of the paper feeding back lever 50 in the clockwise direction is restricted by the noise reduction pad 45, the generation of the collision noise is prevented. During the above-described paper ordering operation, only the paper feeding back lever 50 is rotated and the paper supplying roller 22 and the paper supporting plate 21 are not rotated.

By the paper ordering operation explained referring FIGS. 6–9, the paper P remaining as the last paper supplied at the separation point is fed back to the upper stream side of the paper transferring direction by the rotation of the paper feeding back lever 50 in the counterclockwise direction and placed on the paper supporting plate 21. Thereby, the separating operation can always start in a condition that the papers are in order and the overlapped feeding or the failed feeding of the papers P can be prevented.

Next, the separating operation of sheets of paper P by the separation mechanism 31 carried out after the above-described paper ordering operation is explained referring FIGS. 5, 10 and 11. FIG. 10 shows the second stage and FIG. 11 shows the third stage.

In the second stage of the separating operation (referring FIG. 10) carried out after the above-described paper ordering operation, the paper supporting plate 21 is rotated around the supporting axis 39 from the initial condition of the separating operation shown in FIG. 5 to the end (the dead bottom point) in the clockwise direction, and the paper supplying roller 22 is rotated in the paper transferring direction (the counterclockwise direction) so that the paper supplying part 22*a* contacts a sheet of paper P. This is carried out by the following operation. When the roller axis A is rotated gradually in the counterclockwise direction from the initial condition shown in FIG. 12, the paper supplying roller 22 is rotated in the paper transferring direction and the cam 70 also rotates in the same direction, thereby, the cam surface 70*a* of the cam 70 shown in FIG. 12 becomes engaged to the concave part 75*a* of the paper supporting plate pressing lever 75.

At this time, the engagement of the projected part 21*a* provided on the paper supporting plate 21 and the contact part 40*a* provided on the pressing part 40 is released and the separation piece contact part 67 formed on the pressing part 40 presses the separation piece 30. Thereby, the separation pad 29 is urged to the paper supplying roller 22 side (the second urging condition) by the first pressing spring 32 and the second pressing spring 33, so that the frictional resistance necessary for separating the papers P can be obtained.

When the paper supporting plate 21 is further rotated in the paper transferring direction (the counterclockwise direction) from the second stage of the separating operation, the papers P placed on the paper supporting plate 21 are held by the separation pad 29 and the paper supplying part 22*a* of the paper supplying roller 22 so that only the paper P contacting the paper supplying roller 22 is transferred into the multi-function apparatus 1. At this time, most of the papers P placed on the paper supporting plate 21 are prevented from being inserted into the separation point by the separation claw 62 (referring FIG. 4). Therefore, a great amount of paper P is not inserted to the separation point at the same time.

Corresponding to the further rotation of the paper supplying roller 22 from the second stage of the separating operation in the counterclockwise direction, the cam 70 is also rotated in the counterclockwise direction, and therefore, the cam surface 70*a* is released from the concave part 75*a* slowly. During the release of the cam surface 70*a* from the concave part 75*a*, they do not contact each other because of the space formed by the cam surface 70*a* and the concave part 75*a*. Therefore, the rotation of the paper supporting plate pressing lever 75 is prevented and the paper supporting plate 21 is maintained in the second stage for a predetermined period so as to continue the urging condition generated by the first pressing spring 32 and the second pressing spring 33.

In the third stage of the separating operation shown in FIG. 11, the paper supporting plate 21 is rotated around the supporting axis 39 in the clockwise direction from the second stage of the separating operation shown in FIG. 10 so that the projected part 21*a* contacts the contact part 40*a*. This is carried out by the following operation. When the roller axis A is further rotated in the counterclockwise, the paper supplying roller 22 is rotated in the paper transferring direction (the counterclockwise direction) so that the paper P is transferred to the transferring roller. The cam 70 is also rotated in the same direction and the rotating mechanism changes as shown in FIGS. 13(*a*)–(*d*). That is, in the process of FIGS. 13(*a*)–(*d*), when the paper supporting plate pressing lever 75 starts to be rotated to press the paper supporting plate 21, the projected part 21*a* formed on the paper supporting plate 21 starts to engage with the contact part 40*a* of the pressure applying part 40, and the separation piece contact part 67 formed on the pressing part 40 moves away from the separation piece 30 to move from the position of the second stage of the separating operation to that of the third stage. Thereby, the separation pad 30 is urged only by the first pressing spring 32 to the paper supplying roller 22 side (the first urging condition), and the back tension caused to the paper P in transferring by the transferring roller can be decreased.

After the third stage of the separation operation, the paper supporting plate 21 continues the rotation in the clockwise direction, and the projected part 21*a* presses down the pressure applying part 40 against the urging force of the second pressing spring 33 via the contact part 40*a*. Then, the separating operation returns to the initial condition shown in FIGS. 5 and 14 to finish the above-described separating operation. In the paper supplying operation including the above-described separating operation and the paper ordering operation, the driving motor 53 provides the driving power via the driving motor 53 and the gear row (not shown) to the rotation of the paper supporting plate 21 around the supporting axis 39, the rotation of the paper feeding back lever 50 around the paper feeding back axis 68, and the rotation of the paper supplying roller 22 in the paper transferring direction (the counterclockwise direction in the drawing).

By the above-structured separation mechanism 31, because the paper feeding back lever 50 is rotated to the upper stream side of the paper transferring direction to press down the separation piece projected part 49 through the separation piece pressing lever 48, and separate the separation piece 30 and the paper supplying roller 22 for feeding back the paper P held between the separation piece 30 and the paper supplying roller 22 to the upper stream side of the paper transferring direction, any stress is not caused on the paper P. Because the paper P held by the separation piece 30 and the paper supplying roller 22 is removed in the initial stage of the supplying operation, the papers P are not piled between the separation piece 30 and the paper supplying roller 22 so that overlapped feeding can be prevented. Because it is not necessary to increase the pressure power between the separation piece 30 and the paper supplying roller 22 so that the papers P are not piled between the separation piece 30 and the paper supplying roller 22, the back tension can be decreased and the deterioration of the paper transferring accuracy caused by the back tension can be prevented.

Because the paper feeding back lever 50 is structured to be rotated around an axis other than the paper supplying roller 22, the operation of the paper feeding back lever 50 is not affected by the structure or the control of the paper supplying roller 22. For example, if the paper feeding back lever 50 were to use the same axis as the paper supplying roller 22 for its rotation, the paper supplying roller 22 would also be rotated in accordance with the rotation of the paper feeding back lever 50, along with other unnecessary structure. Therefore, problems can be caused in the posture of the paper. However, such problems can be precisely prevented in the structure of the preferred embodiment.

As explained in detail above, in the multi-function apparatus 1 of the preferred embodiment, when the papers P are separated one at a time by the separation piece 30, the paper supporting plate 21 is rotated to be in the second position by the rotating mechanism to release the engagement of the projected part 21*a* and the contact part 40*a* of the pressure applying part 40 and press the separation piece 30 using the separation piece contact part 67. Thereby, the separation piece 30 contacts the paper supplying roller 22 with a large urging force from the first pressing spring 32 and the second pressing spring 33. When the paper P that is separated by the separation piece 30 is transferred, the paper supporting plate 21 is rotated to be in the first position by the rotating mechanism to engage the projected part 21*a* and the contact part 40*a* of the pressure applying part 40 and release the pressure to the separation piece 30 from the separation piece contact part 67. Thereby, the separation piece 30 contacts the paper supplying roller 22 with a small urging force from the first pressing spring 32.

Because the urging force for urging the separation piece 30 toward the paper supplying roller 22 is switched between the paper separating operation by the separation piece 30 and the paper transferring operation after the paper separating operation, the paper separating operation using the separation piece 30 and the paper transferring operation after the paper separating operation, can be carried out easily and accurately. Because the rotating mechanism is a simple structure that may include the cam 70 and the paper supporting plate pressing lever 75, the rotation timing of the paper supporting plate 21 can be controlled freely by the shape of the cam surface 70*a* of the cam 70. The urging force to the separation piece 30 can be switched easily according to the separating/transferring pattern of the paper P by the paper supplying roller 22 without using the electrical structure.

When the paper P is separated, the urging force toward the separation piece 30 is switched to be large to increase the pressure power operated between the paper supplying roller 22 and the separation piece 30, thereby the overlapped transferring of the paper P can be prevented. When a sheet of paper P is transferred after the separation, the urging force toward the separation piece 30 is switched to be small to decrease the pressure power operated between the paper supplying roller 22 and the separation piece 30. Thereby, the tension (back tension) generated to the paper P is decreased and the deterioration of the paper transferring accuracy can be prevented.

Further, because the urging force of the separation piece 30 against the paper supplying roller is switched between the two kinds of power of large or small according to the movement of the paper supporting plate 21, the urging force switching mechanism can be simply structured utilizing the movement of the paper supporting plate 21.

In the paper supplying operation including the above-described separating operation and the paper ordering operation, the driving motor 53 provides the driving power via the driving motor 53 and the gear row (not shown) to the rotation of the paper supporting plate 21 around the supporting axis 39, the rotation of the paper feeding back lever 50 around the paper feeding back axis 68, and the rotation of the paper supplying roller 22 in the paper transferring direction (the counterclockwise direction in the drawing).

When a paper to be manually fed is placed on the manual feeding paper placing stand 65, the paper is guided to the upper part before the paper P placed on the paper supporting plate 21, by using the first manual paper feeding film 43*a* and the second manual paper feeding film 43*b*. Therefore, the manually fed paper is guided to the separation point with priority over the paper P and transferred into the multi-function apparatus 1 by the transferring roller 24. Further, the second manual paper feeding film 43*b* is structured to guide the both sides of the paper for manual feeding. Thereby, the manually fed paper can be prevented from being hooked on the abovedescribed separation claw 62 which would deform the paper so that a feeding failure may be caused. When the manually fed paper is placed on the manual feeding paper placing stand 65, the same process as the above-described paper supplying operation is made.

While this invention has been described in conjunction with specific embodiments thereof, it is evident that many alternatives, modifications and variations will be apparent to those skilled in the art. Accordingly, the preferred embodiments of the invention as set forth herein are intended to be illustrative, not limiting. Various changes may be made without departing from the spirit and scope of the invention as defined.

In the paper supplying device of the invention, because the urging device may comprise a first urging part and a second urging part, the urging force for urging the separation part is switched between a large urging force and a small urging force by switching between a first urging condition urged by only the first urging part and a second urging condition urged by the cooperation of the first urging part and the second urging part. The switching of the urging condition is operated in a condition that the first urging part can be always urged toward the paper supplying roller with a predetermined urging force and the switching of the urging condition is operated by only the movement of the second urging part by the second urging part switch. For example, when the papers are separated one at a time by the separation piece, the second urging part switch moves the second urging part in a position being cooperative with the first urging part, and when the paper is transferred after the separation of the paper by the separation piece, the second urging part switch switches the second urging part in a position being non-cooperative with the first urging part. Thus, the urging force for urging the separation piece toward the paper supplying roller is switched between the paper separating operation using the separation piece, and the paper transferring operation after the paper separating operation. Therefore, the paper separating operation using the separation piece and the paper transferring operation after the paper separating operation, can be carried out easily and accurately.

Another paper supplying device of the invention may comprise a paper supplying roller rotatable around a first axis and for supplying a paper in a predetermined direction, a separation piece for separating papers one at a time by contacting the paper supplying roller, an urging part for urging the separation piece toward the paper supplying roller, a separation piece moving away part for moving the separation piece away from the paper supplying roller against an urging force produced by the urging part, a second axis extended parallel to the first axis, and a pair of paper feeding back levers rotatable around the second axis in a vicinity of the separation piece. After the rotation of the paper supplying roller stops by stopping an operation of the first axis, an operation of the second axis starts, and thereby the paper feeding back lever is rotated toward an upper stream side of the paper transferring direction so as to move the separation piece away from the paper supplying roller via the separation piece moving away part and feed back the paper to the upper stream side of the paper transferring direction. Therefore, the paper held between the separation piece and the paper supplying roller can be fed back to the upper stream side of the paper transferring direction without causing any stress on the paper.

Because the paper held by the separation piece and the paper supplying roller is removed, the papers are not piled between the separation piece and the paper supplying roller, and therefore, overlapped feeding can be prevented. Because it is not necessary to increase the pressure power between the separation piece and the paper supplying roller so that the papers are not piled between the separation piece and the paper supplying roller, the back tension can be decreased. Because the paper feeding back lever is structured to be rotated around the second axis other than the paper supplying roller, the operation of the paper feeding back lever is not affected by the structure or the control of the paper supplying roller. For example, if the paper feeding back lever were to use the same axis as the paper supplying roller for its rotation, the paper supplying roller would also rotated in accordance with the rotation of the paper feeding back lever, along with other unnecessary structure. Thus, problems can be caused in the posture of the paper. However, such problems can be precisely prevented in the structure of the invention.

What is claimed is:

1. A sheet feeding device, comprising:

a paper supporting part that stores a plurality of papers and being positioned movably between at least a first position and a second position;

a paper supplying roller provided in a lower side of the paper supporting part that supplies sheets of paper in a predetermined direction;

a separation piece that separates the stored papers one at a time from the paper supplying roller;

an urging device that urges the separation piece toward the paper supplying roller; and a switch that switches an urging force from the urging device between a first urging condition and a second urging condition that has a larger urging force than the first urging condition, wherein the urging device comprises a first urging part that urges the separation piece with a predetermined urging force toward the paper supplying roller and a second urging part that is different from the first urging part, and the switch comprises a second urging part switch that switches a position of the second urging part from a position being cooperative with the first urging part to a position being non-cooperative with the first urging part, so that the separation piece is urged only by an urging force of the first urging part in the first urging condition and the separation piece is urged by an urging force of both the first urging part and the second urging part in the second urging condition.

2. The sheet feeding device of claim 1, further comprising:

a transporting roller in a lower side of the paper supplying roller along a paper transporting direction of the paper supplying roller, wherein in the separation of the paper from the paper supporting part, the second urging part switch switches the second urging part to a position being cooperative with the first urging part until the paper reaches the transferring roller, and switches the second urging part to a position being non-cooperative with the first urging part after the paper reaches the transferring roller.

3. The sheet feeding device of claim 1, wherein the second urging part switch comprises the paper supporting part, the second urging part switch switching only the second urging part from a position being cooperative with the first urging part to a position being non-cooperative with the first urging part, in accordance with a movement of the paper supporting part between the first position that the paper supporting part moves away from the paper supplying roller and the second position that the paper supporting part moves closer to the paper supplying roller during a series of separating operations.

4. The sheet feeding device of claim 1, wherein the first urging part is set to have an urging force so that a plurality of papers placed slanted on the paper supporting part presses the separation piece by their own weight to prevent unnecessary insertion of the papers into the paper supplying roller side.

5. The sheet feeding device of claim 1, wherein the urging force of the second urging part is set larger than the urging force of the first urging part.

6. The sheet feeding device of claim 1, further comprising:

a separation piece moving away part for moving the separation piece away from the paper supplying roller against the urging force of the urging part; and a pair of paper feeding back levers rotatable around a second axis in a vicinity of the separation piece, the second axis being extended parallel to a first axis;

wherein after the rotation of the paper supplying roller stops, an operation of the second axis starts, and thereby the paper feeding back lever is rotated toward an upper stream side of a paper transferring direction so as to move the separation piece away from the paper supplying roller via the separation piece moving away part and the paper is fed back to the upper stream side of the paper transferring direction.

7. The sheet feeding device of claim 1, wherein the second urging part comprises a spring and a pressure applying part connected to the spring, for transmitting an urging force to the separation piece, the pressure applying part having on its one end a separation piece contact part that contacts the separation piece and on its another end a paper support part contact part that contacts a lower end of the paper supporting part.

8. The sheet feeding device of claim 7, wherein when the paper supporting part moves to the first position, the paper supporting part contacts the paper supporting part contact part to move the pressure applying part to a position being non-cooperative with the first urging part and when the paper supporting part moves to the second position, the contact of the paper supporting part with the paper supporting part contact part is released to move the pressure applying part to a position being cooperative with the first urging part.

9. The sheet feeding device of claim 1, wherein the second urging part switch is provided on both ends of the paper supporting part and comprises a cam rotatable around a same axis of the paper supplying roller and a lever movable up and down around an axis by contacting the cam.

10. The sheet feeding device of claim 9, wherein the cam has a cam surface deciding a moving timing of the paper supporting part between the first position and the second position in the series of separating operations, the lever is guided by the cam surface of the cam in a process of rotation of the cam corresponding to the rotation of the paper supplying roller, the lever moving the paper supporting part between the first position and the second position.

11. The sheet feeding device of claim 10, wherein the cam surface of the cam has a shape for moving the paper supporting part to the first position to maintain the second urging part in the position being non-cooperative with the first urging part in an initial stage of the series of the separating operation, a shape for moving the second urging part in the position being cooperative with the first urging part and moving the paper supporting part to the second position to maintain the position of the second urging part in a second stage where the paper reaches the transferring roller, and a shape for moving the paper supporting part to the first position to move again the second urging part in the position being non-cooperative with the first urging part in a third stage where the paper has reached the transferring roller.

* * * * *